United States Patent [19]

Moriguchi et al.

[11] Patent Number: 4,535,340

[45] Date of Patent: Aug. 13, 1985

[54] METHOD AND APPARATUS FOR THERMAL PRINTING

[75] Inventors: Haruhiko Moriguchi; Takashi Omori; Toshiharu Inui, all of Ebina, Japan

[73] Assignee: Fuji Xerox Co. Ltd., Tokyo, Japan

[21] Appl. No.: 620,258

[22] Filed: Jun. 13, 1984

[30] Foreign Application Priority Data

Jun. 21, 1983 [JP] Japan ..... 58-111474

[51] Int. Cl.[3] ..... H05B 3/00

[52] U.S. Cl. ..... 346/76 PH; 219/216

[58] Field of Search ..... 346/76 PH, 76 R; 219/216 PH; 400/120; 101/93.03, 93.04; 250/317.1; 358/78, 296–298; 364/518–523; 340/785, 798, 799, 802

[56] References Cited

U.S. PATENT DOCUMENTS

| | | | |
|---|---|---|---|
| 3,725,898 | 4/1973 | Canton | 214/216 PH |
| 4,168,421 | 9/1979 | Ito | 346/76 R |
| 4,330,786 | 5/1982 | Hatabe et al. | 346/76 PH |

*Primary Examiner*—E. A. Goldberg
*Assistant Examiner*—A. Evans
*Attorney, Agent, or Firm*—Cushman, Darby & Cushman

[57] ABSTRACT

A thermal head is provided with a plurality of juxtaposed heat generating resistors for applying heat to heat sensitive printing medium for reproducing a picture. The resistance values of the heat generating resistors are individually detected at predetermined times and used to update the contents of a memory means. An arithmetic operating circuit calculates quantities of electric power to be supplied to respective heat generating resistors for causing them to generate the same quantity of heat irrespective of the difference in the resistance values of the heat generating resistors.

10 Claims, 1 Drawing Figure

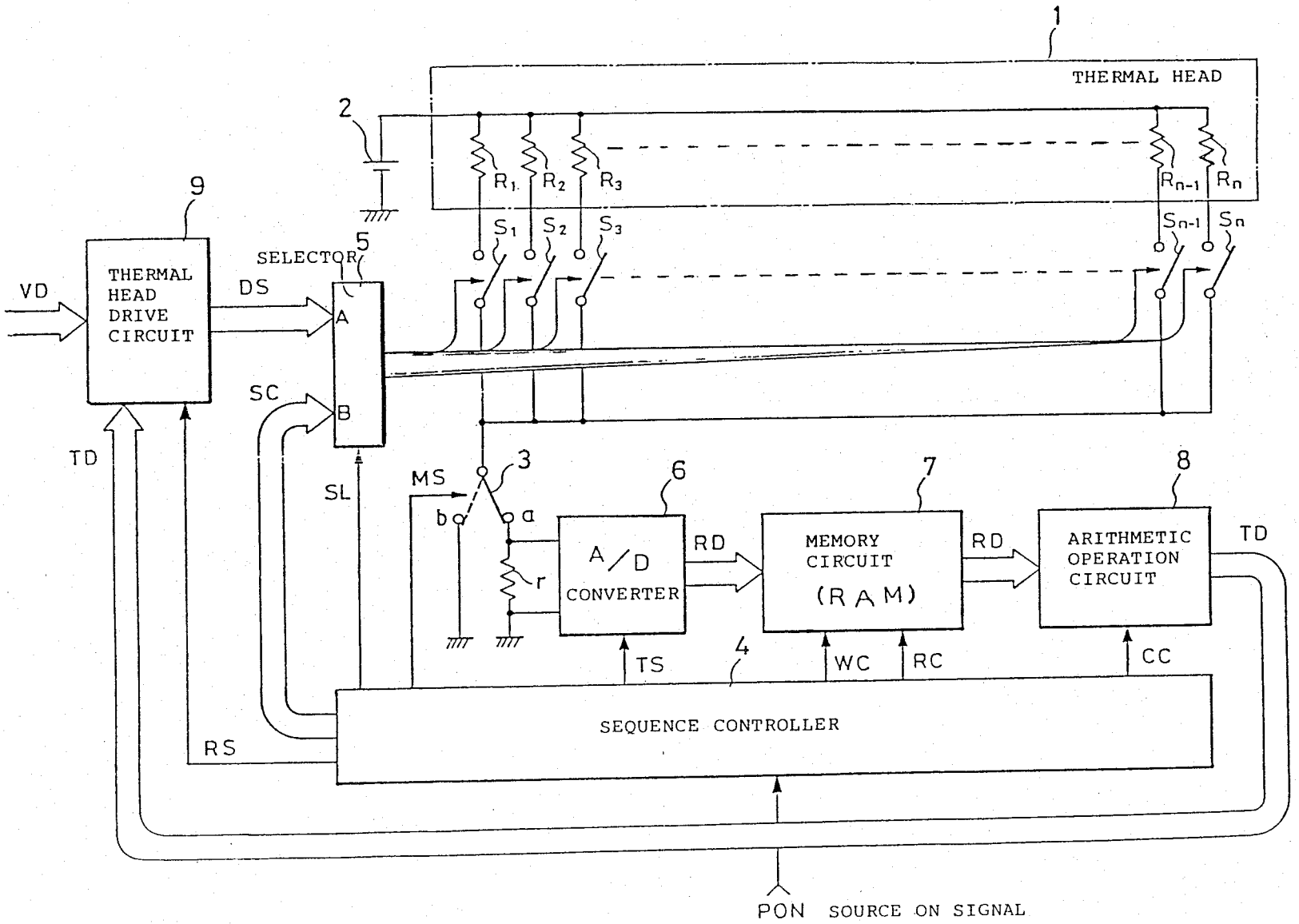
THERMAL HEAD
1
$R_n$
$R_{n-1}$
$R_3$
$R_2$
$R_1$
$S_n$
$S_{n-1}$
$S_3$
$S_2$
$S_1$
2
5
SELECTOR
A
B
DS
SC
SL
9
THERMAL HEAD DRIVE CIRCUIT
VD
TD
3
a
b
MS
r
6
A/D CONVERTER
TS
RD
7
MEMORY CIRCUIT (RAM)
RC
WC
8
ARITHMETIC OPERATION CIRCUIT
CC
4
SEQUENCE CONTROLLER
RS
PON
SOURCE ON SIGNAL

METHOD AND APPARATUS FOR THERMAL PRINTING

BACKGROUND OF THE INVENTION

1. Field of the Invention

This invention relates to a method and apparatus for effecting thermal printing, by utilizing a heat sensitive printing medium, and more particularly to a method and apparatus for thermal printing wherein nonuniform heating of heat generating members caused by their unequal registance values is automatically compensated for.

2. Description of the Prior Art

Generally, a thermal head of heat sensitive printing head comprises a plurality of heat generating resistors corresponding to the number of picture elements in the scanning direction of a recording medium. For example, where a picture information is printed on a printing paper having a size of the Japanese Industrial Standard, Series A, No. 4, 1728 resistors are used, whereas where a picture information is printed on a printing paper having a size of the Japanese Industrial Standard, Series B, No. 4, 2048 resistors are used. Electric power corresponding to the picture information is supplied to respective heat generating resistors to cause them to generate heat. Accordingly, when the heat sensitive printing medium is brought into slide contact with the thermal head, a portion of the printing medium corresponding to an energized heat generating resistor generates heat to change color. When the heat sensitive printing medium comprises an ink donor film, the ink applied thereon melts or evaporates to reproduce a picture image corresponding to the picture information.

Where the heat generating resistors of the thermal heat are made of thick film type heat generating elements, their resistance values usually differs by 20–30%. Even when the heat generating resistors are made of thin film type heat generating elements their resistance values differ by 5–20%.

Thus, inequality of the resistance values of respective heat generating resistors of the thermal head is inevitable so that the quality of the printed picture image is not excellent due to nonuniform tone. More particularly, where the thermal head is driven with constant voltage, the quantity of heat generated by each heat generating resistor is proportional to $V^2/R$, where V represents the impressed voltage and R the resistance value of each heat generating resistor. Where constant current flows through the thermal head, the quantity of heat generated by each heat generating resistor is proportional to $I^2R$, where I represents the current, and R the resistance value of each heat generating resistor. As above described, the quantity of heat generated by each heat generating resistor, or the tone of the printed picture image is influenced directly by its resistance value. Accordingly, when the resistance values R of respective resistors are not equal, the tone of the printed picture image is not uniform.

Recently, it has been desired that the printed picture image should have a high density as well as a high picture quality. Nonuniformity of the resistance values of the resistors not only degrades the quality of the printed picture image, but also decreases the yield of satisfactory resistors which results in the increase in the cost of manufacturing the resistors.

SUMMARY OF THE INVENTION

It is, therefore, an object of this invention to provide a novel method and apparatus for heat sensitive recording capable of always obtaining uniform and high quality picture images irrespective of nonuniformity of the resistance values of the heat generating resistors of a thermal head.

Another object of this invention is to provide a novel method and apparatus for heat sensitive printing wherein a plurality of heat generating resistors of a thermal head can generate equal quantity of heat corresponding to the tone of a picture information thereby obtaining picture images of high quality.

Still another object of this invention is to provide a novel method and apparatus for heat sensitive printing wherein electric power supplied to heat generating resistors of a thermal head is calculated so as to cause respective heat generating resistors of a thermal head to generate same quantity of heat irrespective of the difference in the resistance values of the resistors.

According to one aspect of this invention, there is provided a method of thermal printing comprising the steps of preparing a thermal printing apparatus including a thermal head constituted by a plurality of juxtaposed heat generating resistors, and memory means; sequentially detecting resistance values of the heat generating resistors at each predetermined time prior to driving the thermal head; storing resistance values of the heat generating resistors in the memory means; updating contents of the memory means in accordance with sequentially detected values of the heat generating resistors; calculating electric power supplied to each heat generating resistor to be operated in accordance with the contents of the memory means for causing respective heat generating resistors to generate the same quantity of heat; and supplying the calculated electric power to a selected one of the heat generating resistors of the thermal head in response to a picture information supplied to the thermal printing apparatus.

According to another aspect of this invention, there is provided thermal printing apparatus comprising a thermal head including a plurality of heat generating resistors which generate heat when supplied with electric power; means for detecting resistance values of respective heat generating resistors in accordance with a signal at a predetermining time before driving the thermal head; memory means for storing resistance values of the heat generating resistors detected by the detecting means; means for updating contents of the memory means each time the detecting means operates; and arithmetic operating circuit for calculating quantity of electric power to be supplied to respective heat generating resistors in accordance with the contents of the memory means; and a thermal head drive circuit for selecting one of the heat generating resistors to be operated in accordance with a picture information supplied to the thermal printing apparatus; the thermal head drive circuit supplying to the selected one of the heat generating resistors electric power of a quantity calculated by the arithmetic operating circuit.

BRIEF DESCRIPTION OF THE DRAWING

In the accompanying drawing, a single FIGURE is a block diagram showing one embodiment of the thermal printing apparatus embodying the invention.

DESCRIPTION OF THE PREFERRED EMBODIMENT

A preferred embodiment of this invention shown in the accompanying drawing comprises a thermal heat 1 provided with a plurality of heat generating resistors $R_1$ to $R_n$ of the member corresponding to the number of picture elements in the direction of scanning, a source of constant voltage 2, switches $S_1$ to $S_n$ connected in series with respective resistors $R_1$ to $R_n$, and a selector 5 controlling the switches $S_1$ to $S_n$. Furthermore, a mode transfer switch 3 is provided to connect the switches $S_1$ to $S_n$ to ground directly or via resistor r. The mode transfer switch 3 is transferred between terminals a and b by a mode selection signal MS produced by a sequence controller 4. When the mode transfer switch 3 is thrown to terminal a, a first operation mode is performed in which the resistance values of the respective heat generating resistors $R_1$ to $R_n$ are stored in a memory circuit 7, and an arithmetic operation is executed based on the resistance values as will be described later in detail. On the other hand, when the transfer switch 3 is thrown to contact b, a second operation mode is performed in which the thermal head 1 is driven. Various operations in the first and second operation modes are also controlled by the sequence controller 4.

The first operation mode will firstly be described. Suppose now that a source switch, not shown, is closed and that a source ON signal PON indicating the closure of the source switch is applied to the sequence controller 4. Then, the sequence controller 4 issues the mode selection signal MS which throws the mode transfer switch 3 to the terminal a, and a selector control signal SL applied to the selector 5 so as to select its input terminal B. Then the sequence controller 4 supplies a scanning signal SC to the selected input terminal B for sequentially ON/OFF controlling switches $S_1$ to $S_n$ at a definite timing. Consequently currents determined by the resistance values of respective resistors $R_1$ to $R_n$ sequentially flow through the resistor r, and the terminal voltages across resistor r proportional to the currents flowing through respective resistors $R_1$ to $R_n$ are sequentially applied to an A/D converter 6.

Then, in response to a timing signal TS supplied from the sequence controller 4 in synchronism with the scanning timing of the scanning signal SC, the A/D converter 6 sequentially converts the voltages across the resistor r (which have values corresponding to the resistance values of respective resistors $R_1$ to $R_n$) into a digital signal having 16 steps, for example. The digital signal thus converted (hereinafter called a resistance value data RD) is applied to a memory circuit 7.

The memory circuit 7 is constituted by a random access memory circuit (RAM) having a capacity corresponding to at least the number of the heat generating resistors $R_1$ to $R_n$ of the thermal head 1. In response to a write control signal WC applied from the sequence controller 4, the memory circuit 7 sequentially stores the output of the A/D converter 6, that is the resistance value data RD, and in response to a read control signal RC sent from the sequence controller 4, the memory circuit 7 sequentially reads out the resistance value data RD stored therein. The write control signal WC is also synchronism with the scanning timing of the scanning signal SC outputted from the sequence controller 4. Upon completion of the ON/OFF scannings of all switches $S_1$ to $S_n$ caused by the scanning signal SC, all resistance value data RD of the heat generating resistors $R_1$ to $R_n$ would be stored in the memory circuit 7. The resistance value data read out by the read control signal RC are then applied to an arithmetic operation circuit 8. When the value represented by the resistance value data RD is equal to $R_i$, the arithmetic operation circuit 8 calcurates a value (in this example, time) of $r_i$ such that the ratio $r_i/R_i$ will be constant. This calculation can be relatively simply accomplished by preparing a table containing values of $r_i$ in a certain range determined by considering the range of nonuniformity of the resistance values of respective heat generating resistors and then selecting one r, of the table having a value closest to satisfy the ratio described above, based on the value of $R_i$ represented by the resistance value data RD. More particularly, where the heat generating resistors $R_1$ to $R_n$ are made of thick film type heat generating elements, for example, their resistance values vary 20 to 30% so that the table may be prepared by describing the value of $r_i$ as time values having 8 steps of 0.1 msec. spacings in a range of 0.5–1.2 msec., for example, so that each time the resistance value data RD is applied, the value of $r_i$ having a value closest to the value that satisfies the condition "$r_i/R_i$=constant", based on the value of $R'_i$ represented by the resistance value data RD. The value of $r_i$ calculated in this manner with reference to respective heat generating resistors $R_1$ to $R_n$ is sent to a thermal head drive circuit 9 as a time data TD for performing the second operating mode, that is for actually driving the thermal head.

The second operation mode is as follows.

When the calculation of the arithmetic operation circuit 8 completes, in response to the mode selection signal MS the sequence controller 4 throws the mode transfer switch 3 to terminal b, and controls selector 5 by the selector control signal SL such that the selector 5 will select input A. Furthermore, the sequence controller 4 sends to the thermal head drive circuit 9 a ready signal RS showing that the preparation for printing has been completed. Then the apparatus shown in the drawing is brought to the second operation mode.

The thermal head drive circuit 9 is enabled when supplied with the ready signal RS, so that in the case of a facsimile device, for example, the thermal head drive circuit 9 is brought into a condition for receiving a picture information VD sent from a receiving device, not shown. Upon receival of the picture information VD, the thermal head drive circuit 9 selects one of the heat generating resistors $R_1$ to $R_n$ of the thermal head 1 to be operated in accordance with the content of the picture information VD. The thermal head drive circuit 9 selects a time data TD corresponding to the selected heat generating resistor among the time data TD calculated by the arithmetic operation circuit 8 so as to form a drive signal for the selected heat generating resistor based on the selected time data TD. The drive signal DS thus formed is applied via the selector 5 to one of the switches $S_1$ to $S_n$ corresponding to the selected heat generating resistor, thus turning on the switch for an interval corresponding to the time data TD of the drive signal DS. As has been pointed out before, this time data TD is constituted by such time value $r_i$ that makes the value of each heat generating resistor to be $r_i/R_i$=constant where the $R_i$ time value is made $r_i$. When the thermal head 1 is driven by such drive signal DS, even when the resistance values of respective heat generating resistors are not equal more or less, such resistance difference is well absorbed, that is can be neglected, whereby selected heat generating resistors generate substantially the same quantity of heat.

The operation of the thermal head drive circuit 9 described above is repeated at each one line of the received picture information VD. When the drive of the thermal head 1 for all lines of the picture information completes, the thermal head drive circuit 9 is brought to a waiting state for receiving the next picture information VD.

By executing the second operation mode of the apparatus, a portion of the heat sensitive printing medium, not shown, corresponding to a selected heat generating resistor of the thermal head and coming into slide contact with the thermal head 1 would be printed with a uniform tone, thus reproducing a high quality picture image precisely corresponding to the picture information.

The drive signal DS formed by the thermal head drive circuit 9 usually takes the form of a pulse signal, the pulse width thereof being determined to correspond to the time data TD.

For the sake of description, in the accompanying drawing, although switches $S_1$ to $S_n$ and mode transfer switch 3 have been illustrated as mechanical switches, they can be substituted by transistor switching elements or the like because of their small size, and high response speed and reliability.

Since in the illustrated embodiment, a source of constant voltage 2 was used for applying the same voltage to respective heat generating resistors $R_1$ to $R_n$, the calculated value $r_1$ of the arithmetic operation circuit 8 was made to be a time data TD, and the interval of application of the constant voltage was controlled in accordance with this time data TD so as to make substantially equal the heat quantities generated by respective heat generating resistors $R_1$ to $R_n$. Alternatively, it is also possible to make the calculated value $r_1$ of the arithmetic operation circuit 8 to be a level data so as to cause the thermal head drive circuit 9 to determine the level of the pulse signal based on the level data. Where such drive signal is applied directly to respective heat generating resistors the heat quantities generated by respective resistors $R_1$ to $R_n$ would become substantially equal. Of course, in this case, the source of constant voltage 2, and switches $S_1$ to $S_n$ are used only for the first operation mode, it will be obvious to one skilled in the art to modify the connection of the circuit elements to provide the same function as the illustrated circuit. The current drive type apparatus can also be readily modified.

Although in the illustrated embodiment, the first operation mode was executed in response to the application of the source ON signal PON, where the invention is applied to a facsimile device, for example, as a signal instructing the execution of the first operation may be used a paging (or call) signal of a telephone set. Any signal which is generated prior to the execution of the thermal printing can be used as a signal for executing the first operation mode. The content of the memory circuit 7 is updated each time the first operation mode is executed. Of course, the resistance values of the heat generating resistors $R_1$ to $R_n$ do not vary with time even when the update is made, the same contents would be maintained.

As above described, the apparatus shown in this embodiment is constructed on the assumption that an ordinary binary printing apparatus is used, but it should be understood that the invention is also applicable to many tone type printing apparatus that can reproduce intermediate tones, too. In such case, the arithmetic operation circuit 8 is constructed such that addition or division operations of the calculated value $r_i$ is repeated for preparing data of a number corresponding to the number of the tone of the recorded picture for each one of the heat generating resistors. Furthermore, the thermal head drive circuit 9 selects one of the heat generating resistors to be energized and a data corresponding to the tone of the picture image among the data prepared by the arithmetic operation circuit 8 for forming the drive signal for the selected heat generating resistor based on the selected data $V_n$ the same manner as above described. The data may be time data or level data depending upon the method of driving the thermal head.

What is claimed is:

1. A method of thermal printing comprising the steps of:

preparing a thermal printing apparatus including a thermal head constituted by a plurality of juxtaposed heat generating resistors, and memory means;

sequentially detecting resistance values of said heat generating resistors at each predetermined time prior to driving said thermal head;

storing resistance values of said heat generation resistors in said memory means;

updating contents of said memory means in accordance with sequentially detected values of said heat generating resistors;

calculating electric power supplied to each heat generating resistor to be operated in accordance with the contents of said memory means for causing respective heat generating resistors to generate the same quantity of heat; and supplying said calculated electric power to a selected one of the heat generating resistors of said thermal head in response to a picture information supplied to said thermal printing apparatus.

2. The method according to claim 1 wherein said resistance value detection is performed each time said apparatus is connected to a source of electric power.

3. The method according to claim 1 wherein said updating of the contents of said memory means is effected each time the resistance value of any heat generating resistor is detected.

4. The method according to claim 1 which further comprises the steps of preparing a memory table storing electric power values to be supplied to respective heat generating resistors and calculating electric power values supplied to said heat generating resistors by reading out contents of said table.

5. The method according to claim 1 wherein said thermal head is driven by a source of constant voltage or constant current, and said power is supplied by controlling an interval of supplying said constant voltage or constant current to said heat generating resistors.

6. Thermal printing apparatus comprising:

a thermal head including a plurality of heat generating resistors which generate heat when supplied with electric power;

means for detecting resistance values of said heat generating resistors in accordance with a signal at a predetermined time before driving said thermal head;

memory means for storing resistance values of said heat generating resistors detected by said detecting means;

means for updating contents of said memory means each time said detecting means operates;

an arithmetic operating circuit for calculating quantity of electric power to be supplied to respective heat generating resistors in accordance with the contents of said memory means; and a thermal head drive circuit for selecting one of said heat generating resistors to be operated in accordance with a picture information supplied to said thermal printing apparatus;

said thermal head drive circuit supplying to said selected one of said heat generating resistors electric power of a quantity calculated by said arithmetic operating circuit.

7. The apparatus according to claim 6 wherein said signal generated at said predetermined time is a source ON signal when a switch for connecting said apparatus to an electric source is closed.

8. The apparatus according to claim 6 wherein said memory means comprises a random access memory circuit.

9. The apparatus according to claim 6 wherein said arithmetic operation circuit includes a memory table for storing quantities of electric power to be supplied to respective heat generating resistors corresponding to the resistance values detected by said detecting means.

10. The apparatus according to claim 6 wherein said thermal head drive circuit includes a source of constant voltage or constant current and wherein supply of electric power to respective heat generating resistors is controlled by controlling intervals of energizing said heaters.

* * * * *